US007957667B2

(12) United States Patent
Otsuka et al.

(10) Patent No.: US 7,957,667 B2
(45) Date of Patent: Jun. 7, 2011

(54) INTERMEDIATE COUPLING UNIT BETWEEN TWO IMAGE FORMING APPARATUSES AND IMAGE FORMING APPARATUS ADAPTABLE THERETO

(75) Inventors: Kazutaka Otsuka, Hachioji (JP); Toshiaki Yajima, Iruma (JP)

(73) Assignees: Casio Electronics Manufacturing Co., Ltd., Iruma-Shi (JP); Casio Computer Co., Ltd., Tokyo (JP)

( * ) Notice: Subject to any disclaimer, the term of this patent is extended or adjusted under 35 U.S.C. 154(b) by 90 days.

(21) Appl. No.: 12/490,704

(22) Filed: Jun. 24, 2009

(65) Prior Publication Data

US 2009/0324285 A1 Dec. 31, 2009

(30) Foreign Application Priority Data

Jun. 26, 2008 (JP) ..... 2008-167741

(51) Int. Cl.
*G03G 15/00* (2006.01)

(52) U.S. Cl. ..... 399/107; 399/110; 399/405

(58) Field of Classification Search ..... 271/3.14, 271/4.01, 9.01, 9.11, 298, 303; 399/124, 399/110, 107, 402, 391, 405; 347/139, 164, 347/262, 264

See application file for complete search history.

(56) References Cited

U.S. PATENT DOCUMENTS 4,972,236 A * 11/1990 Hasegawa
5,150,167 A * 9/1992 Gonda et al.
5,162,845 A * 11/1992 Ariyama et al.

FOREIGN PATENT DOCUMENTS

JP 04296772 A * 10/1992
JP 09-054465 A 2/1997
JP 2005-028598 A 2/2005
JP 2007-163809 A 6/2007

* cited by examiner

*Primary Examiner* — David P Porta
*Assistant Examiner* — Milton Gonzalez
(74) *Attorney, Agent, or Firm* — Holtz, Holtz, Goodman & Chick, PC

(57) ABSTRACT

Provided are intermediate coupling unit that can maintain universal applicability of image forming apparatus so it can singly form images/be installed in small offices, but can also couple two apparatuses if necessary, and image forming apparatus adaptable to this unit. Intermediate coupling unit includes carry-in port at lower surface right side, plural conveying roller pairs sandwiching and conveying internally-carried-in recording medium, discharge ports formed near upper surface right/left ends for externally discharging recording medium, first/second flaps switching among conveying paths, A, B, C, paper discharge tray fixed at upper internal position, and internal paper feed cassette detachable downward. Two identical-shape printers are linked through conveying path A and enable double-speed-printing when coupled to top/bottom of intermediate coupling unit to face same direction, and linked through conveying path B and enable fast-double-side-printing when coupled to face opposite directions.

5 Claims, 10 Drawing Sheets

INTERMEDIATE COUPLING UNIT BETWEEN TWO IMAGE FORMING APPARATUSES AND IMAGE FORMING APPARATUS ADAPTABLE THERETO

BACKGROUND OF THE INVENTION

1. Field of the Invention

The present invention relates to an intermediate coupling unit that couples two image forming apparatuses, each of which can singly form images, for making high speed printing, printing with an additional application of special toner, improving image quality, etc., and to an image forming apparatus adaptable to the intermediate coupling unit.

2. Description of the Related Art

There have conventionally been color image forming apparatuses that form an image by forming a toner image on an image support according to an electrophotographic manner using toner, transferring the toner image onto a sheet of paper, and fixing the transferred toner image on the sheet of paper by a pressure and heat using a fixing unit.

Such electrophotographic image forming apparatuses are required to have a higher image forming speed year by year. A measure that has been employed to realize the higher image forming speed is to increase a rotation linear velocity of a paper conveying mechanism, an image forming unit, etc.

However, if the rotation linear velocity is simply increased, it will become necessary to raise the temperature of a heat generating roller in order to maintain the fixing function of a fixing unit, or to newly install a fixing roller having a large diameter in order to maintain the fixing nip time.

These two measures have their own problems: raising the fixing temperature will result in a large power consumption, and increasing the diameter of the fixing roller will make it hard for a toner-fixed sheet of paper to be detached from the fixing roller.

As a solution to these problems, Unexamined Japanese Patent Application KOKAI Publication No. 2007-163809 proposes an image forming apparatus that includes two image forming units and two fixing units. According to this solution, the print processing capacity is doubled even at a normal speed because there are two image forming units. Furthermore, since the two image forming units that print at the normal speed each have a fixing unit, there is no need of raising the temperature of the heat generating roller or increasing the diameter of the fixing roller.

Further, recently, from the cost and resource saving concerns, double-side printing has been promoted in image forming apparatuses such as copying machines, facsimiles, etc. It has conventionally been general to provide an image forming apparatus with a sheet overturning mechanism to make the image forming apparatus capable of double-side printing. However, since a sheet overturning mechanism necessarily entails a switchback behavior, the operation slows down accordingly, which has been a factor that hinders the speeding up of the apparatus on the whole.

As a method for solving such a problem and realizing fast double-side printing, Unexamined Japanese Patent Application KOKAI Publication No. H09-054465 proposes fast double-side printing realized by preparing two printers that have a single-side printing function and setting the printers' transfer units to face each other so that a sheet of paper that is output from the paper discharge port of the first printer may be conveyed to the paper feed port of the second printer.

However, the technique of Unexamined Japanese Patent Application KOKAI Publication No. 2007-163809 is a configuration of a last printing-only machine that includes two image forming units and two fixing units in one housing. At a glance, this machine looks large, expensive, and intricate to handle, and is not suitable for such offices where a normal printing speed is good enough and not much paper is consumed. Hence, this machine is problematic in that it lacks universal applicability, from the standpoint of the seller of the machine.

The technique of Unexamined Japanese Patent Application KOKAI Publication No. H09-054465 inevitably takes a lateral arrangement of the two printers and requires double the space of a single printer for installation, which is likewise not suitable for small offices.

SUMMARY OF THE INVENTION

The present invention was made in view of the above circumstances, and an object of the present invention is to provide an intermediate coupling unit that can maintain universal applicability of an image forming apparatus so it can singly perform image formation or can be installed in a small office, but can also couple two image forming apparatuses if necessary, and an image forming apparatus that is adaptable to the intermediate coupling unit.

To accomplish the object of the present invention described above, an intermediate coupling unit according to a first aspect of the present invention is installed in attachable and detachable manner between two image forming apparatuses, which are arranged in a vertical direction and are each capable of singly forming an image, and the intermediate coupling unit includes: a first conveying path that conveys a recording medium discharged from a lower one of the image forming apparatuses to an upper one of the image forming apparatuses without changing a direction in which the recording medium is discharged; a second conveying path that conveys a recording medium discharged from the lower image forming apparatus to the upper image forming apparatus by changing the direction in which the recording medium is discharged; and a third conveying path that leads a recording medium discharged from the lower image forming apparatus to an internal paper discharge tray to be contained therein without conveying the recording, medium to the upper image forming apparatus.

The intermediate coupling unit according to the present invention and having the above configuration includes a paper feed cassette that is attachable and detachable to/from a lower portion of the body of the intermediate coupling unit and in which a recording medium that is feedable to the first or the second conveying path is contained.

The intermediate coupling unit according to the present invention and having the above configuration has its internal space, which emerges when the paper feed cassette is detached from the body, constitute the space above a paper discharge tray of the lower image forming apparatus.

To accomplish the object of the present invention described above, an image forming apparatus according to a second aspect of the present invention includes: an image recording unit for a toner image; a transfer medium onto which the toner image is primarily transferred by the image recording unit; a pair of standby conveying rollers that conveys a recording medium, which is fed from a paper feed cassette correspondingly to a recording timing; a secondary transfer unit that secondarily transfers the toner image onto the recording medium from the transfer medium onto which the toner image has been primarily transferred; a recording medium conveying path that is formed by a substantially-vertical sequential bottom-up alignment of a recording medium carry-in port of a fixing unit and a recording medium discharge port of the fixing unit, which fixes the toner image on the recording medium, onto which the toner image has been secondarily transferred; an external paper feed path that, in a portion of the recording medium conveying path that is below the pair of standby conveying rollers, joins a paper feed path through which a recording medium is led from the paper feed cassette, and whose paper-feeding-side end, which is below a region where the joining occurs, opens downward to outside; and an external paper discharge path that branches from a recording medium discharge path leading to a paper discharge tray in a portion of the recording medium conveying path that is above the recording medium discharge port of the fixing unit and that opens upward to outside at a paper-discharging-side end of the external paper discharge path, which is above a region where the branching occurs, wherein the image forming apparatus is capable of singly performing normal printing on the recording medium, and is capable of being coupled to the intermediate coupling unit according to one of the above configurations in an attachable and detachable manner at the upper surface or at the lower surface of the image forming apparatus.

With this configuration it is possible to provide an intermediate coupling unit that maintains universal applicability of an image forming apparatus and couples two image forming apparatuses to allow them to be installed in a small office, and an image forming apparatus that is adaptable to the intermediate coupling unit.

Accordingly, a user can use each image forming apparatus singly, and can also easily achieve system enhancement such as a faster operation only by purchasing an intermediate coupling unit and adding it to the image forming apparatuses used singly so far, if necessary.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

The embodiments of the present invention will now be specifically explained below.

Embodiment 1

An embodiment of the present invention will now be explained in detail below with reference to the drawings. In the explanation below, the above-described image recording unit for a toner image is constituted by, for example, an image forming section 12 and the like, the transfer medium onto which the toner image is primarily transferred is constituted by, for example, a transfer belt 24 and the like, the secondary transfer unit is constituted by, for example, the facing portions of the transfer belt 24 and a secondary transfer roller 36 and the like, and the fixing unit is constituted by, for example, a belt type fixing unit 37 and the like.

Figure 1:
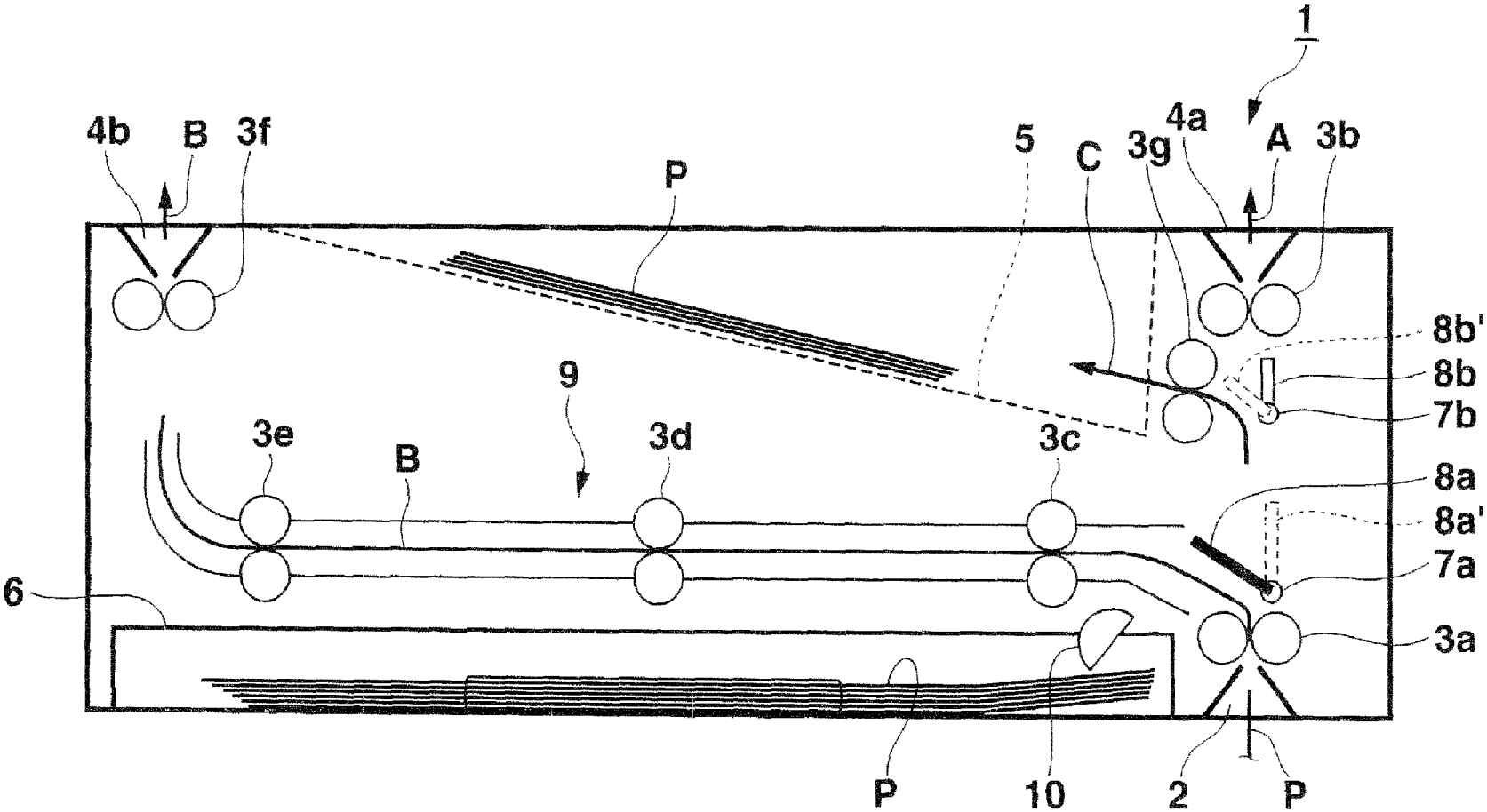
FIG. 1 is a cross sectional diagram showing the configuration of an intermediate coupling unit according to the Embodiment 1 of the present invention.

FIG. 1 is a cross sectional diagram showing the configuration of an intermediate coupling unit according to the Embodiment 1 of the present invention. The intermediate coupling unit 1 shown in FIG. 1 is installed intermediately and in attachable/detachable manner between later-described two image forming apparatuses, which are arranged in the vertical direction.

The intermediate coupling unit 1 has a carry-in port 2 that is positioned at the right side of its lower surface and from which a recording medium P discharged from an underlying image forming apparatus is guided to its interior. The intermediate coupling unit 1 includes plural pairs of conveying rollers 3*a* and 3*b* through 3*g* that sandwich and convey the recording medium P guided into its interior from the carry-in port 2.

Further, the intermediate coupling unit 1 has discharge ports 4*a* and 4*b* that are positioned at the right and left sides of its upper surface respectively, and from which a recording medium P that is fed into its interior from the carry-in port 2 is discharged to the outside. The intermediate coupling unit 1 includes a paper discharge tray 5 that is fixedly set at an upper position of its interior, and a paper feed cassette 6 that is at a lower position of its interior and is detachable from the lower surface downward.

The above-described pair of conveying rollers 3*a* is disposed immediately above the carry-in port 2, and the pair of conveying rollers 3*b* is disposed immediately below the discharge port 4*a* that is at the right side of the upper surface. A first flap 8*a* that turns about a hinge 7*a* to a solid line position and to a broken line position 8*a*' is disposed immediately above the pair of conveying rollers 3*a*. A second flap 8*b* that turns about a hinge 7*b* to a solid line position and to a broken line position 8*b*' is disposed immediately below the pair of conveying rollers 3*b*.

The above described pair of conveying rollers 3*g* is disposed between the broken line position 8*b*' of the second flap 8*b* and the paper discharge tray 5.

The intermediate coupling unit 1 further includes a guide member 9 that exists between the paper discharge tray 5 and the paper feed cassette 6 and extends horizontally and that links the carry-in port 2 to the discharge port 4*b* that is at the left side of the upper surface. The pairs of conveying rollers 3*c*, 3*d*, and 3*e* described above are provided on the guide member 9. The pair of conveying rollers 3*f* is disposed immediately below the discharge port 4*b*.

In the configuration described above, the intermediate coupling unit 1 forms a first conveying path A, along which a recording medium P discharged from the underlying image forming apparatus is conveyed to the overlying image forming apparatus without a change of the direction in which the recording medium P is discharged, by the carry-in port 2, the pair of conveying rollers 3*a*, the first flap 8*a* turning to the broken line position 8*a*', the second flap 8*b* turning to the solid line position, the pair of conveying rollers 3*b*, and the discharge port 4*a*.

Further, in the configuration described above, the intermediate coupling unit 1 forms a second conveying path B, along which a recording medium P discharged from the underlying image forming apparatus is conveyed to the overlying image forming apparatus with changes of the direction in which the recording medium P is discharged, by the carry-in port 2, the pair of conveying rollers 3*a*, the first flap 8*a* turning to the solid line position, the guide member 9, the pair of conveying rollers 3*f*, and the discharge port 4*b*.

Furthermore, in the configuration described above, the intermediate coupling unit 1 forms a third conveying path C, along which a recording medium P discharged from the underlying image forming apparatus is sent to the internal paper discharge tray 5 to be contained therein without being conveyed to the overlying image forming apparatus, by the carry-in port 2, the pair of conveying rollers 3*a*, the first flap 8*a* turning to the broken line position 8*a*', the second flap 8*b* turning to the broken line position 8*b*', and the pair of conveying rollers 3*g*.

The intermediate coupling unit 1 can pick up a recording medium P stored in the paper feed cassette 6 sheet by sheet by a paper feed roller 10, and convey the picked-up recording medium P through the above-described first conveying path A or second conveying path B to the image forming apparatus coupled to the top of the intermediate coupling unit 1 when it is necessary.

The paper feed cassette 6 may store, for example, sheets of special paper that is not prepared in an overlying or underlying printer 11*a* or 11*b*, so that when it is necessary to print on a sheet of special paper, one in the paper feed cassette 6 may be fed from the intermediate coupling unit 1 to the overlying printer 11*a*.

The intermediate coupling unit 1 can be configured to have its internal space constitute the space above the discharge tray of the image forming apparatus coupled to the bottom of the intermediate coupling unit 1, when the paper feed cassette 6 is detached from its lower surface downward or in the horizontal direction to make the internal space emerge.

Embodiment 2

Figure 2:
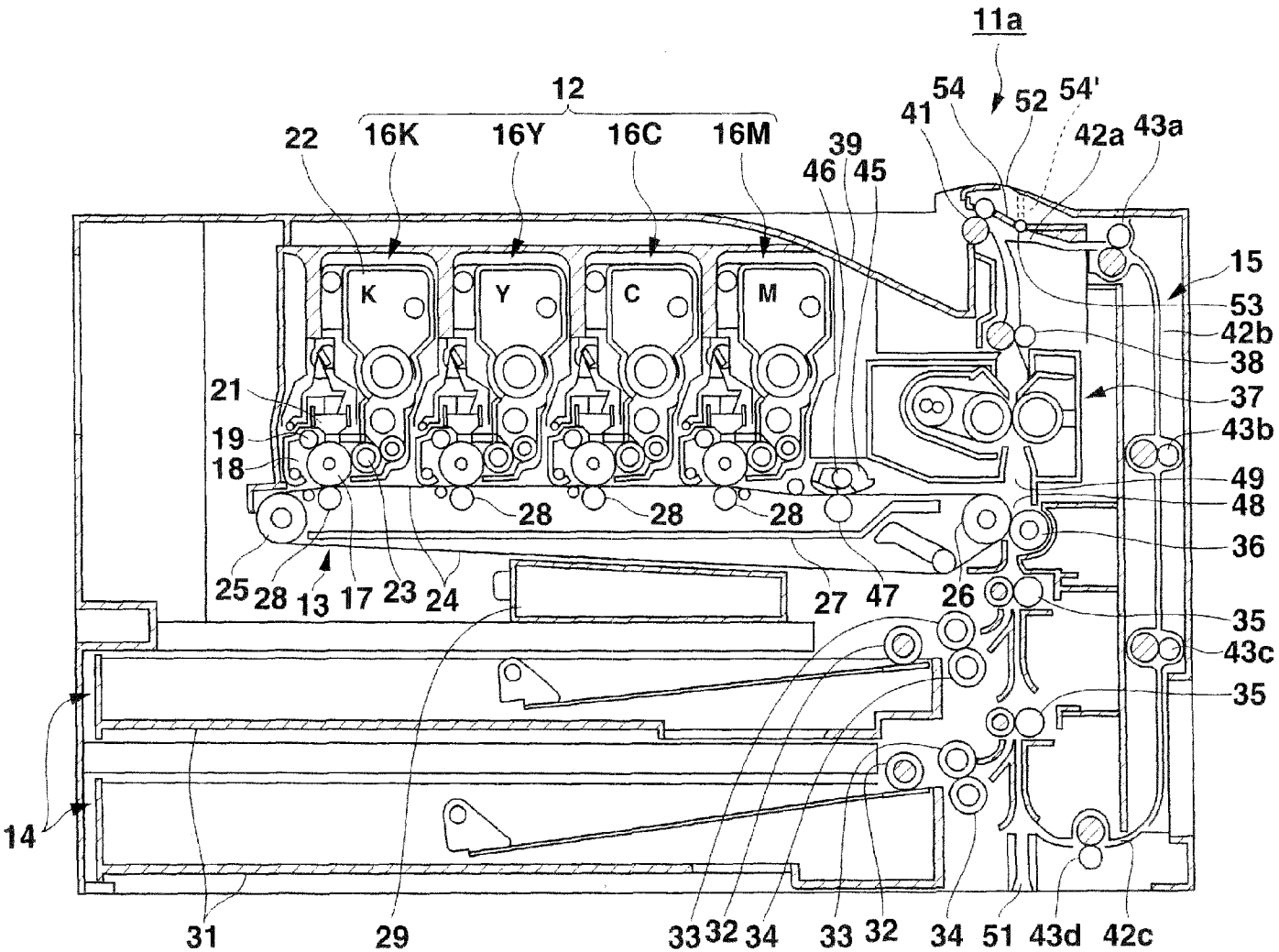
FIG. 2 is a cross sectional view, seen from the front, showing the configuration of an image forming apparatus (printer) coupled to the upper surface or the lower surface of the intermediate coupling unit of the Embodiment 1, according to the Embodiment 2.

FIG. 2 is a cross sectional view, seen from the front, showing the configuration of an image forming apparatus (hereinafter simply referred to as "printer") coupled to the upper surface or the lower surface of the intermediate coupling unit 1 of the Embodiment 1, according to the Embodiment 2 of the present invention.

Figure 3:
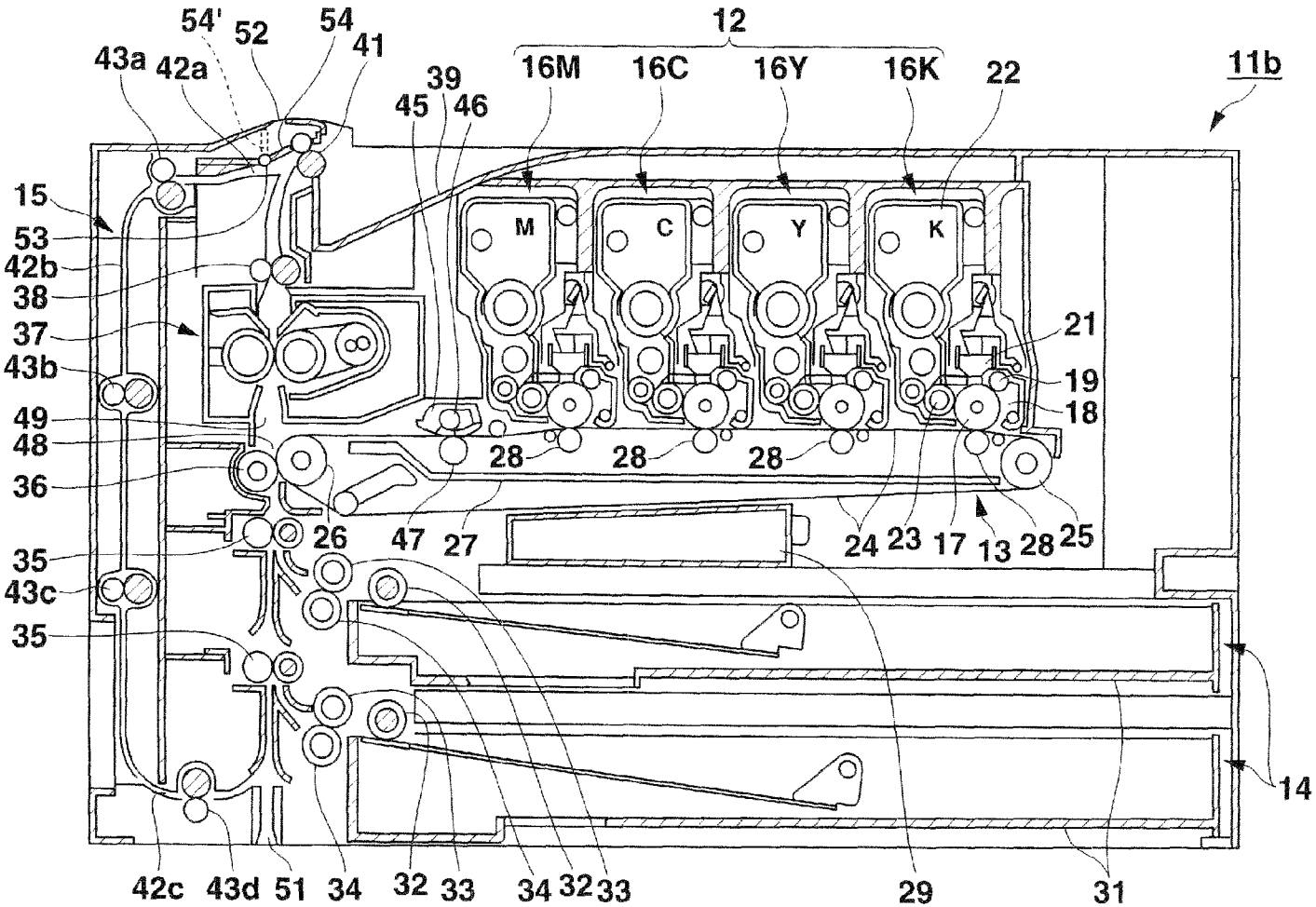
FIG. 3 is a cross sectional view, seen from the rear, of the image forming apparatus (printer) according to the Embodiment 2.

FIG. 3 is a cross sectional view of the printer 11 of FIG. 2 seen from the rear. Since the front view and the rear view of the printer 11 shown in FIG. 2 and FIG. 3 are symmetrical with respect to the cross sectional surface, FIG. 2 and FIG. 3 are the specular reflection of each other.

In the following explanation, the same single printer 11 will be referred to as printer 11*a* when seen in the perspective of FIG. 2, and as printer 11*b* when seen in the perspective of FIG. 3. The other structural components are common in FIG. 2 and FIG. 3, so denoted by the common reference numerals in FIG. 2 and FIG. 3.

The printer 11 (11*a*, 11*b*) shown in FIG. 2 and FIG. 3 is an electrophotographic tandem color image forming apparatus of a secondary transfer type, and includes an image forming section 12, an intermediate transfer belt unit 13, a paper feed unit 14, and a double-side printing purpose conveying unit 15.

The image forming section 12 has a multistage configuration in which four image forming units 16 (16M 16C, 16Y, 16K) are arranged side by side from the right to the left in FIG. 2 (from the left to the right in FIG. 3).

Of the four image forming units 16, the three image forming units 16M, 16C, and 16Y at the upstream side (the right side of FIG. 2 or the left side of FIG. 3; the same applies hereinafter) form a mono-color image by color toners of magenta (M), cyan (C), and yellow (Y) respectively, which are the three subtractive primary colors. The image forming unit 16K forms a monochrome image by a black (K) toner, which is used mainly for letters, dark portions in an image, etc.

All the image forming units 16 described above have the same configuration except the color of the toner stored in the toner container (toner cartridge). Hence, their configuration will be explained below with the black (K) image forming unit 16K taken as an example.

The image forming unit 16 includes a photoconductive drum 17 at its lowermost portion. The circumferential surface of the photoconductive drum 17 is made of, for example, an organic photoconductive material. Around the region near the circumferential surface of the photoconductive drum 17, a cleaner 18, a charging roller 19, an optical writing head 21, and a developing roller 23 of a developing unit 22 are arranged.

The developing unit 22 has a toner of either magenta (M), cyan (C), yellow (Y), or black (K) stored in a toner container that is at its upper portion, and includes a toner replenishing mechanism that is at its middle portion and replenishes the toner downward.

The developing unit 22 has the above-described developing roller 23 in all opening of its lower side surface, and includes inside a toner stirring member, a toner feed roller that feeds the toner to the developing roller 23, and a doctor blade or the like that regulates the toner layer on the developing roller 23 to a certain thickness.

The intermediate transfer belt unit 13 includes a flat endless transfer belt 24 that extends in a loop in substantially the center of the printer body from substantially the left end to the right end of the drawing, and a drive roller 25 and slave roller 26 over which the transfer belt 24 is hung across to rotatorily move the transfer belt 24 in the counterclockwise direction of the drawing.

The transfer belt 24 has a toner image directly transferred onto its belt surface (primarily transferred), and in order to further transfer the toner image onto a sheet of paper (secondarily transfer), conveys the toner image to the position at which the toner image is transferred onto a sheet of paper. Hence, the entire unit is referred to as intermediate transfer belt unit here.

The intermediate transfer belt unit 13 includes a belt position control mechanism 27 within the loop of the flat loop transfer belt 24. The belt position control mechanism 27 has primary transfer rollers 28 that are made of a conductive foam sponge that is pressed against the lower circumferential surface of the photoconductive drums 17 via the transfer belt 24.

The belt position control mechanism 27 moves three primary transfer rollers 28, which correspond to three image forming units 16M, 16C, and 16Y for magenta (M), cyan (C), and yellow (Y) such that the rollers 28 rotate about a hook-like support shaft synchronously.

The belt position control mechanism 27 moves one primary transfer roller 28 corresponding to the image forming unit 16K for black (K) to rotate in a different rotation cycle from the synchronous cycle of the above three primary transfer rollers 28 so that the transfer belt 24 may be detached from the photoconductive drum 17.

That is, the belt position control mechanism 27 switches the transfer belt 24 of the intermediate transfer belt unit 13 to be in a position for a full color mode (in which all the four primary transfer rollers 28 contact the transfer belt 24), a monochrome mode (in which only the primary transfer roller 28 corresponding to the image forming unit 16K contacts the transfer belt 24), or a complete non-transfer mode (in which all the four primary transfer rollers 28 are separated from the transfer belt 24).

The intermediate transfer belt unit 13 has a belt cleaner unit that is disposed on its upper surface in a region further upstream of the image forming unit 16M which is in the most upstream region in the belt moving direction, and a flat thin waste toner collection vessel 29 that is disposed in attachable/detachable manner on substantially the entirety of its lower surface as if the vessel conformed to the lower surface.

The paper feed unit 14 includes two paper feed cassettes 31 that are disposed in upper and lower two stages. Near the paper feed port (the right side in FIG. 2 or the left side in FIG. 3) of each of the two paper feed cassettes 31, a paper pickup roller 32, a feed roller 33, a separation roller 34, and a pair of standby conveying rollers 35 are disposed.

A secondary transfer roller 36 that is pressed against the slave roller 26 via the transfer belt 24 is disposed in the paper feeding direction of the pair of standby conveying rollers 35 (disposed vertically above the rollers 35 in FIG. 2 and FIG. 3) and constitutes a secondary transfer unit that works on a sheet of paper.

A belt type fixing unit 37 is disposed in the region downstream of the secondary transfer unit (the region above the secondary transfer unit in the drawing). In the region downstream of the belt type fixing unit 37 are disposed a pair of carry-out rollers 38 that carries a toner-fixed sheet of paper out from the belt type fixing unit 37, and a pair of paper discharge rollers 41 that discharges the carried-out sheet of paper to a paper discharge tray 39 that is formed in the upper surface of the apparatus.

The double-side printing purpose conveying unit 15 includes a starting return path 42*a* that branches out from the conveying path running between the pair of carry-out rollers 38 and the pair of paper discharge rollers 41 described above to the right side of the drawing, an intermediate return path 42*b* formed by bending the starting return path 42*a* downward, an ending return path 42*c* that ultimately overturns a sheet of paper being returned, formed by bending the intermediate return path 42*b* to the left side oppositely to as described above, and four pairs of returning rollers 43*a*, 43*b*, 43*c*, and 43*d* disposed on the way of these return paths.

The exit of the ending return path 42*c* connects with the conveying path that leads to the pair of standby conveying rollers 35 corresponding to the lower paper feed cassette 31 of the paper feed unit 14.

In the present example, a cleaning unit 45 and a catch roller 46 are disposed on the upper surface of the intermediate transfer belt unit 13.

The cleaning unit 45 gets in contact with the upper surface of the transfer belt 24 and rubs away waste toner. The catch roller 46 catches the waste toner removed by the cleaning unit 45, stores it in a temporary store in the belt cleaner unit unillustrated, and conveys the stored waste toner to an upper level of a drop-down cylinder by a conveying screw to send the waster toner through the drop-down cylinder into the waste toner collection vessel 29.

Further, in order for the cleaning unit 45 to be pressed against the transfer belt 24 with an adequate pressure, the intermediate transfer belt unit 13 is provided with a pressing roller 47 that presses the transfer belt 24 to the cleaning unit 45 from below.

As shown in FIG. 2 and FIG. 3, the printer 11 is not the conventional type of directly transferring a toner image onto a sheet of paper, but a type that transfers a toner image via the transfer belt 24 onto a sheet of paper, which is vertically conveyed to the secondary transfer unit by the pair of standby conveying rollers 35.

Hence, in a maintenance work for getting rid of any trouble that occurs in the paper conveying path such as a paper jam, it is possible to tackle the trouble only by opening the right hand side of FIG. 2 (the left hand side of FIG. 3).

Since troubles such as a paper jam do not occur at where kit components are installed, the space in which refill components such as the kit components, which concentrate in the left side of FIG. 2 (right side of FIG. 3), are installed is made as small as required to replace the refill components only by moving the refill components in the longer direction of the components to attach or detach the components.

This makes the interval between the kit components shortest possible and promotes compactness of the entire apparatus. Furthermore, the optical writing head is also made compact and close to the photoconductive drum.

Additionally, in order to make it possible to replace refill components such as kit components by moving the components in their longer direction from both the front and rear sides to attach or detach the components, the printer 11 has a front door on its front and a rear door on its rear.

The printer 11 (11*a*, 11*b*) can singly perform normal printing on a recording medium like an ordinary printer. The printer 11 can also be coupled, at its upper surface or its lower surface, to the intermediate coupling unit 1 in attachable/detachable manner. When two printers 11 (11*a*, 11*b*) are coupled to the intermediate coupling unit from above and below, the printers can perform various operations, which will be described later in detail.

The configuration of the printer 11 (11*a*, 11*b*) that can be coupled to the intermediate coupling unit described above in attachable/detachable manner will further be explained with reference to FIG. 2 and FIG. 3 again.

First, the pairs of standby conveying rollers 35, the secondary transfer unit 48 constituted by the transfer belt 24 and the facing portions of the slave roller 26 and the secondary transfer roller 36, a recording medium carry-in port 49 of the belt type fixing unit 37, and the pair of carry-out rollers 38 that constitutes a recording medium discharge port of the belt type fixing unit 37 are sequentially disposed substantially vertically from the bottom upward, and form one vertical recording medium conveying path.

This recording medium conveying path includes an external paper feed path 51 that, at underneath the pair of standby conveying rollers 35, joins a paper feed path through which a recording medium is fed from the paper feed cassette 31, and whose paper-feeding-side end, which is beneath that junction, opens downward to the outside.

Further, the recording medium conveying path includes an external paper discharge path 52 that, at above the pair of carry-out rollers 38 constituting the recording medium discharge port of the belt type fixing unit 37, branches from the recording medium discharge path leading to the paper discharge tray 39, and whose paper-discharging-side end, which is above the branch, opens upward to the outside.

At the branch of the recording medium discharge path leading to the paper discharge tray 39 is provided a flap 54 that turns about a hinge 53 to a solid line position 54 and to a broken line position 54'.

Though not shown in particular, an electric installation unit, on which a predetermined number of circuit boards can be attached, is provided at an appropriate position inside the apparatus frame of the printer 11. A circuit board mounted with a control device composed of a plurality of electronic parts is attached on this electric installation unit.

Figure 4:
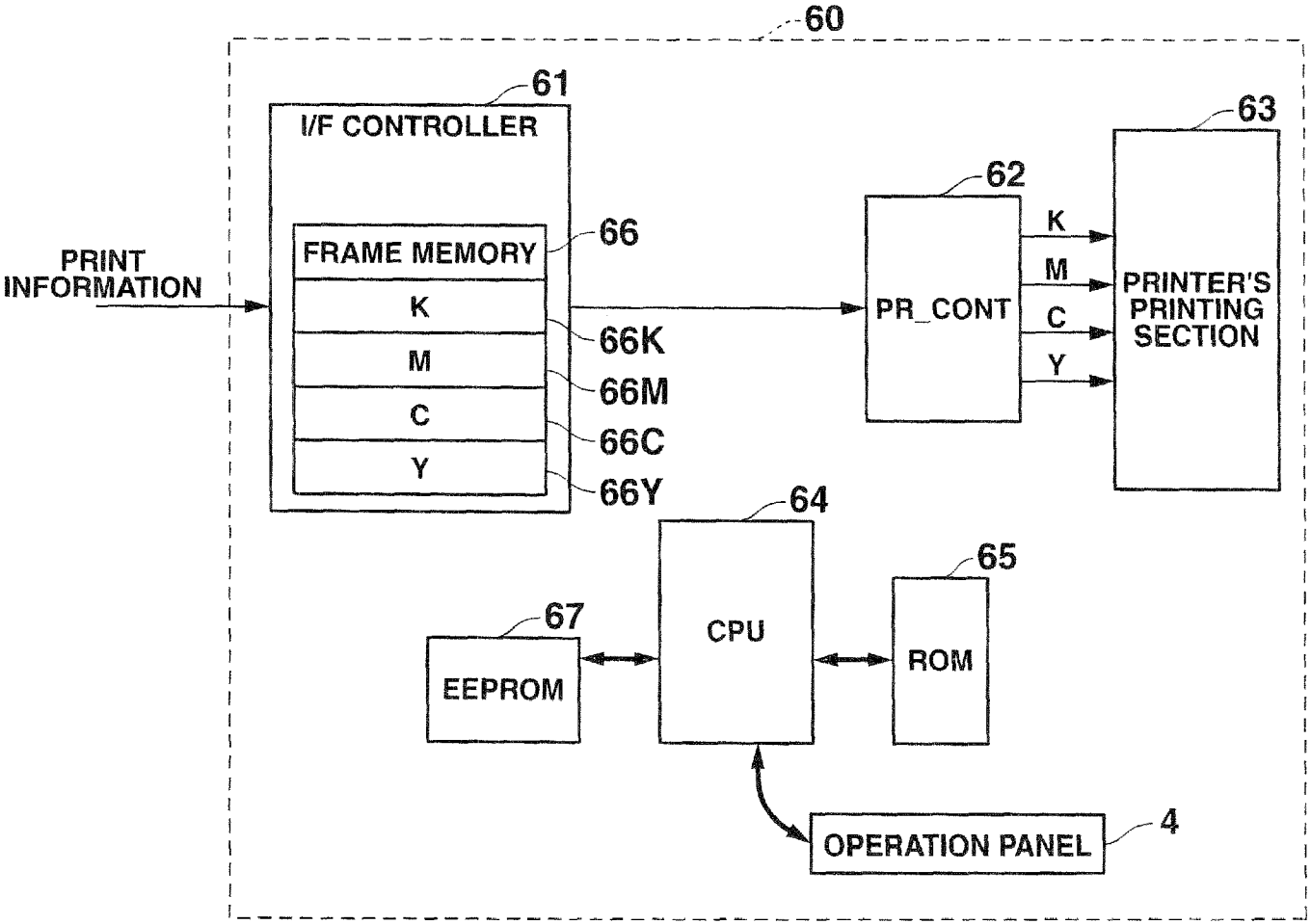
FIG. 4 is a block diagram showing the circuit configuration of a control device of the image forming apparatus (printer) according to the Embodiment 2.

FIG. 4 is a block diagram showing the circuit configuration of the control device. As shown in FIG. 4, the control device 60 includes an interface controller (hereinafter referred to as I/F controller) 61 and a printer controller (PR_CONT) 62 connected to the I/F controller 61. An unillustrated host computer is connected to the I/F controller 61, and a printer's printing section 63 is connected to the printer controller 62.

A CPU 64 is connected to the I/F controller 61 and to the printer controller 62. The CPU 64 controls the I/F controller 61 and the printer controller 62 in accordance with a system program stored in a ROM 65.

The I/F controller 61 generates pattern data corresponding to one sheet of paper according to print information output by the host computer. In this case, the pattern data generated by the I/F controller 61 is, for example, image data corresponding to each color of magenta (M), cyan (C), yellow (Y), and black (K).

These pieces of pattern data for the respective colors are stored in the storage areas 66K, 66M, 66C, and 66Y for the respective colors of a frame memory 66 provided in the I/F controller 61.

Under the control of the CPU 64, these pieces of pattern data are output to the printer controller 62, and output to the printer's printing section 63 for the black (K) (adhesive agent (B)), magenta (M), cyan (C), and yellow (Y) toners respectively.

An operation panel 4 (unillustrated in FIG. 2 and FIG. 3) is connected to the CPU 64, and various external operation signals are entered to the CPU 64 via the operation panel 4.

An EEPROM 67 is connected to the CPU 64. The EEPROM 67 stores, for example, paper size data detected by an unillustrated paper feed sensor and an instruction for double-side printing and timing data, or memorizes data about whether the printer is coupled to the intermediate coupling unit 1 or not, and if coupled, whether the printer is coupled to the top or the bottom of the intermediate coupling unit 1.

With the configuration described above, when the printer 11 is single, a monochrome or full-color toner image that is formed by the image forming section 12 and primarily transferred to the transfer belt 24 is secondarily transferred to a recording medium that is picked up by the paper pickup roller 32 from the paper feed cassette 31 of the paper feed unit 14 and conveyed to the secondary transfer unit 48 via the pair of standby conveying rollers 35. The recording medium onto which the toner image is secondarily transferred is conveyed to the belt type fixing unit 37, which fixes the toner image onto the sheet surface.

At this time (i.e., when the printer 11 is single), the flap 54 is at the solid line position. Hence, the recording medium on whose surface the toner image is fixed is discharged from the belt type fixing unit 37 through the pair of carry-out rollers 38, guided to the direction of the pair of paper discharge rollers 41, and discharged onto the paper discharge tray 39 with its image-recorded surface facing downward.

In this way, when the printer 11 is single, it prints a monochrome or full-color image on a single side or both sides of a recording medium and discharges the recording medium to the paper discharge tray 39 like an ordinary printer.

Embodiment 3

Next, as the Embodiment 3, modes of a system for using two of the printer 11 (11*a*, 11*b*) described above, and coupling the two printers 11 to the top and bottom of the intermediate coupling unit 1 will be explained below.

Embodiment 3-1

Figure 5:
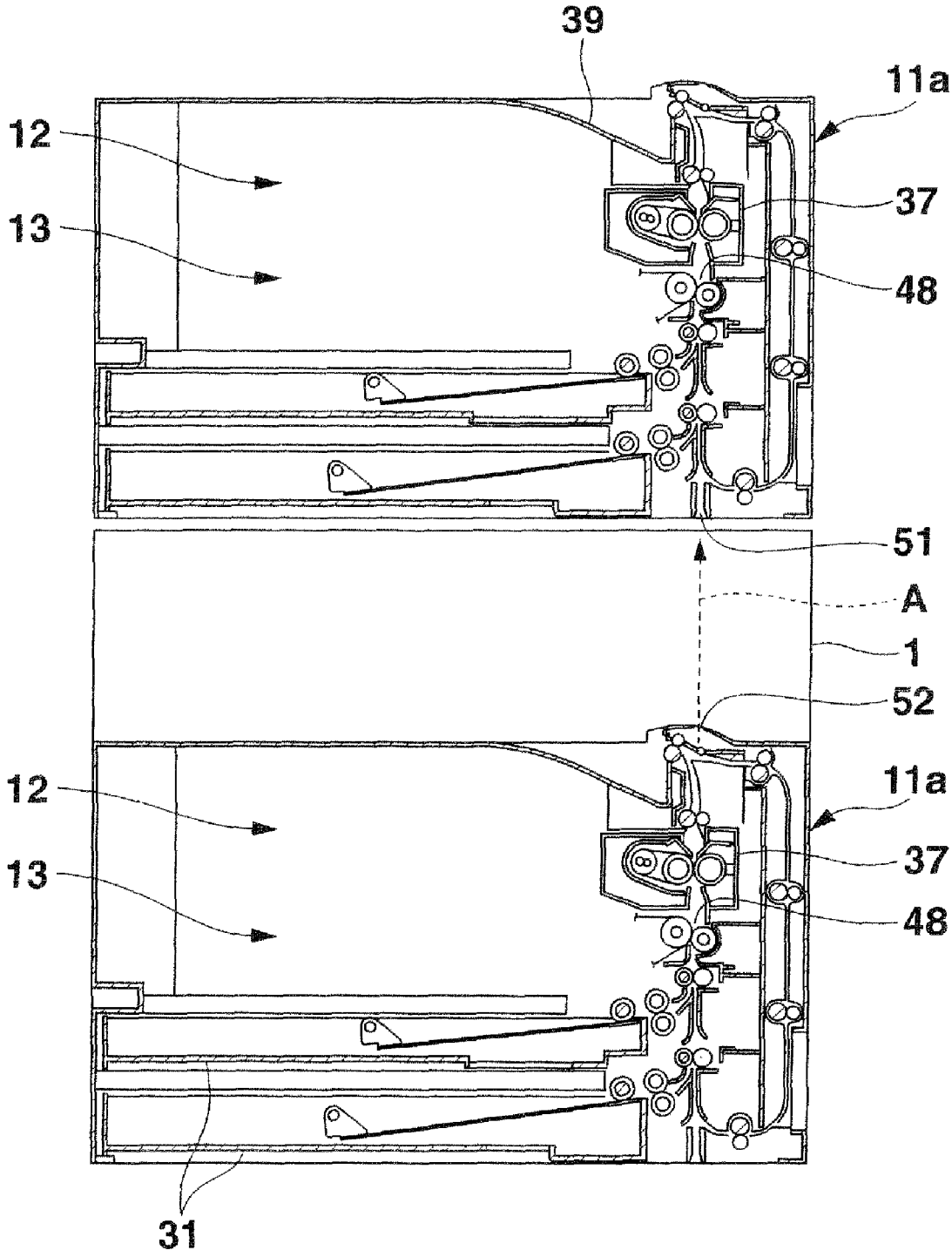
FIG. 5 is a diagram (part 1) explaining a state of two printers being coupled to the top and bottom of the intermediate coupling unit, and a manner to use them, according to the Example 1 of the Embodiment 3.

FIG. 5 is a diagram explaining a state of the two printers 11*a* being coupled to the top and bottom of the intermediate coupling unit 1, and a manner to use them, according to the Example 1 of the Embodiment 3.

To avoid making the drawing complicated to see, FIG. 5 omits the image forming section 12 and the intermediate transfer belt unit 13 from the printers 11*a* and omits all the internal components from the intermediate coupling unit 1.

FIG. 5 assigns the same reference numerals as in FIG. 1, FIG. 2, and FIG. 3 to those of the same components as in FIG. 1, FIG. 2 and FIG. 3 that are indispensable for explanation.

As shown in FIG. 5 (reference should also be made to FIG. 2 and FIG. 3), when two printers 11*a* are coupled to the top and bottom of the intermediate coupling unit 1, the lower printer 11*a* is set to turn the flap 54 (see FIG. 2) to the broken line position 54' to guide a recording medium discharged from the belt type fixing unit 37 through the pair of carry-out rollers 38 to the external paper discharge path 52.

After this, this printer 11*a* primarily transfers a toner image formed by the image forming section 12 onto the intermediate transfer belt unit 13 and secondarily transfers at the secondary transfer unit 48, the primarily transferred toner image onto a recording medium picked up from the paper feed cassette 31.

Then, the recording medium onto which the toner image is secondarily transferred is conveyed to the belt type fixing unit 37. After the belt type fixing unit 37 fixes the toner image onto the sheet surface, the recording medium is discharged from the external paper discharge path 52 to an external paper feed path 51 of the printer 11*a*.

The recording medium discharged into the intermediate coupling unit 1 is carried through the first conveying path A (see FIG. 1) in the intermediate coupling unit 1 to be let into the interior of the printer 11*a* coupled to the top of the intermediate coupling unit 1 through the external paper feed path 51 of this printer 11*a*.

The printer 11*a* coupled to the top of the intermediate coupling unit 1 is set to turn the flap 54 (see FIG. 2) to the solid line position to guide the recording medium discharged from the belt type fixing unit 37 through the pair of carry-out rollers 38 to the paper discharge tray 39.

In the image forming units 16 (16M, 16C, 16Y, 16K) in the image forming section 12 of the printer 11*a* coupled to the top of the intermediate coupling unit 1, for example, medium color toners of light magenta and light cyan, a toner that produces a color in response to invisible ultraviolet or infrared rays, an adhesive toner for sealable postcards. etc. are stored instead of M, C, Y, and K color toners according to the applications.

When forming an image with a high tone, the printer 11*a* coupled to the top of the intermediate coupling unit 1 forms it by the medium colors of light magenta and light cyan at the image forming section 12. When forming an image with a special effect, this printer 11*a* forms it by the toner that produces a color in response to ultraviolet or infrared rays at the image forming section 12. When performing printing that requires a sealable postcard or security, the printer 11*a* forms an image by the adhesive toner at the image forming section 12. Then, the printer 11*a* transfers the image onto the intermediate transfer belt unit 13.

When a recording medium is carried into the printer 11*a* coupled to the top of the intermediate coupling unit 1, this printer 11*a* coupled to the top secondarily transfers, at the secondary transfer unit 48, the medium color toners, the toner that produces a color in response to invisible light, the adhesive toner or the like onto the recording medium, on which an image with an incomplete gray level or a normally printed image has been fixed by the printer 11*a* coupled to the bottom of the intermediate coupling unit 1. The secondarily transferred toner is fixed by the belt type fixing unit 37 and the recording medium is discharged to the paper discharge tray 39.

Embodiment 3-2

Figure 6:
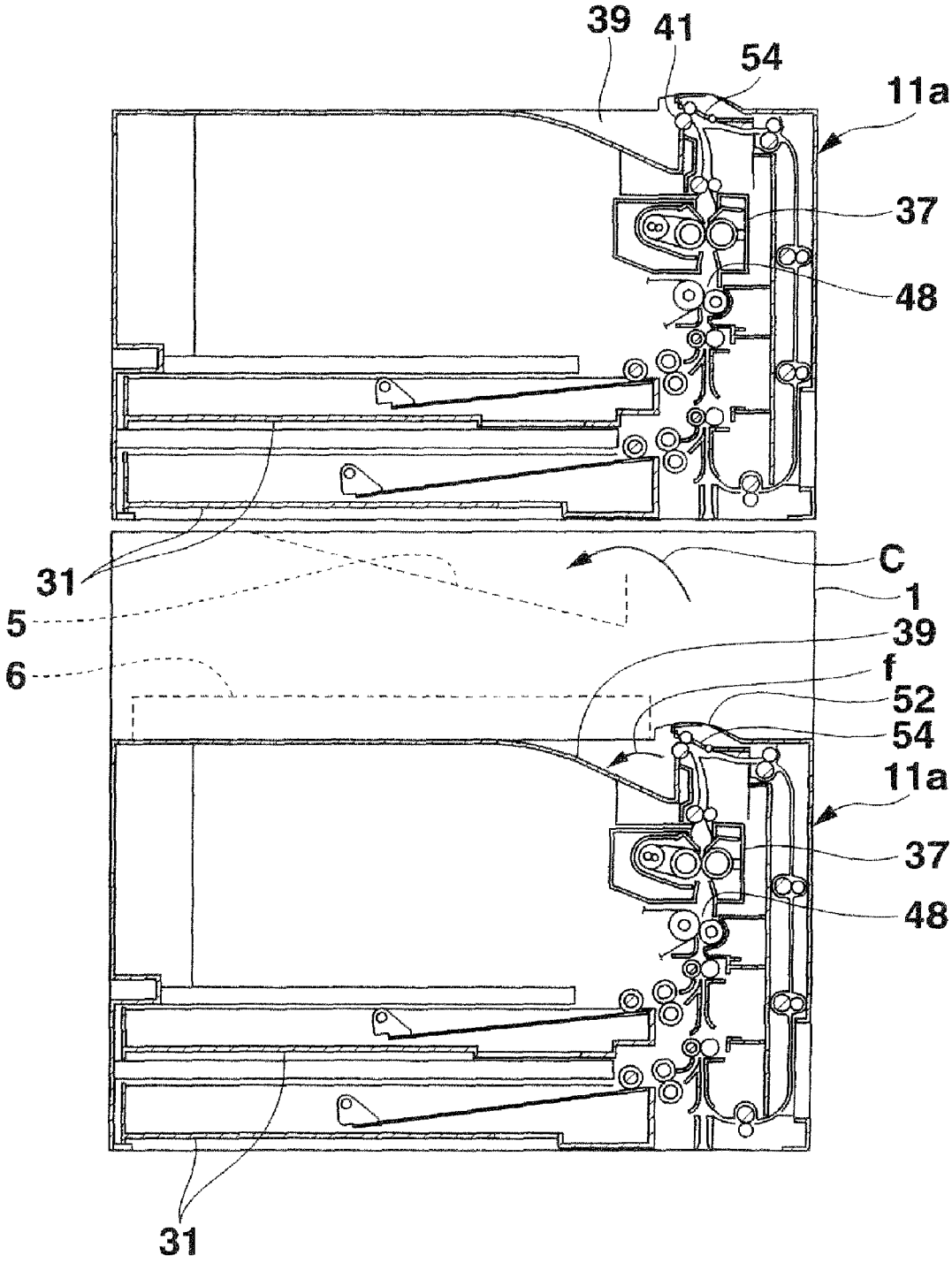
FIG. 6 is a diagram (part 2) explaining a state of two printers being coupled to the top and bottom of the intermediate coupling unit, and a manner to use them, according to the Example 2 of the Embodiment 3.

FIG. 6 is a diagram explaining a state of two printers 11*a* being coupled to the top and bottom of the intermediate coupling unit 1, and a manner to use them, according to the Example 2 of the Embodiment 3.

In order to avoid making the drawing complicated to see, FIG. 6 also omits the image forming section 12 and the intermediate transfer belt unit 13 from the printers 11*a* and omits all the internal components from the intermediate coupling unit 1.

FIG. 6 assigns the same reference numerals as in FIG. 1, FIG. 2, and FIG. 3 to those of the same components as in FIG. 1, FIG. 2, and FIG. 3 that are indispensable for explanation.

In the present example, the two printers 11*a* individually and independently perform printing as if there were no intermediate coupling unit 1, and double the printing speed as a whole. Since their operation is as normal, the load imposed on each unit of the printers is the same as in a normal printing operation. Hence, no special care needs to be taken for maintenance of each unit of the printers (a maintenance measure to prepare for speeding up).

To double the printing speed as the whole, when printing many copies, for example, a hundred copies of a document, the upper and lower two printers 11*a* each print fifty copies at a normal speed. Further, when printing only one copy of a document that however contains many pages, for example, three hundred pages, the upper and lower printers 11*a* share the print jobs like the upper printer 11*a* prints the first to the hundred-and-fiftieth pages and the lower printers 11*a* prints the hundred-and-fifty-first to the three-hundredth pages.

In a case where it is necessary to print a plurality of different contents each by plural copies, it is possible to improve the printing speed as the whole easily in a like sharing manner by letting the two printers take care of different contents.

In the present example, though the two printers 11*a* and 11*a* perform printing individually and independently as if there were no intermediate coupling unit 1, it is not that the intermediate coupling unit 1 is totally no use.

Particularly, the lower printer 11*a* has two ways of discharging a recording medium. One is to normally discharge a recording medium onto the paper discharge tray 39, in which case there needs to exist a room behind the paper discharge tray 39 (at the left side of the drawing) for a discharged recording medium to be stacked, so the paper feed cassette 6 of the intermediate coupling unit 1 coupled to the top of the lower printer 11 is detached beforehand.

Since the paper feed cassette 6 is configured detachable from the lower surface of the intermediate coupling unit 1 downward or in the horizontal direction, when the paper feed cassette 6 is detached, the internal space of the intermediate coupling unit 1 that emerges by the detachment constitutes the space above the paper discharge tray 39 of the underlying printer 11*a*.

Hence, in a case where the printer 11*a* coupled to the bottom of the intermediate coupling unit 1 performs printing independently, its paper discharge tray 39 can have a sufficient space and overcome paper discharging inconvenience due to an insufficient space when a sheet of paper is discharged onto the paper discharge tray 39 as indicated by an arrow f. As regards the printer 11*a* coupled to the top of the intermediate coupling unit 1, there is no worry about space insufficiency above the paper discharge tray 39 because there is enough free space behind and above the paper discharge tray 39.

The other way of discharging a recording medium of the lower printer 11*a* is to turn the flap 54 to the broken line position 54' of FIG. 2 to direct the paper discharge path to the external paper discharge path 52 and discharge the recording medium onto the paper discharge tray 5 inside the intermediate coupling unit 1 through the third conveying path C of the intermediate coupling unit 1 explained in FIG. 1. In this case, it is possible to do without detaching the paper feed cassette 6.

Embodiment 3-3

It is all good to have the two printers share the print jobs and do their share to realize double speed printing, but when the printing ends, it is necessary to take the trouble of picking up the printed recording media from the upper and lower paper discharge trays 39 or from the paper discharge tray 5 and sorting the recording media out or putting them together.

As the Example 3, a printing manner that can eliminate the labor of sorting or putting together the printed recording media that have been printed on a shared basis will be explained below.

Figure 7:
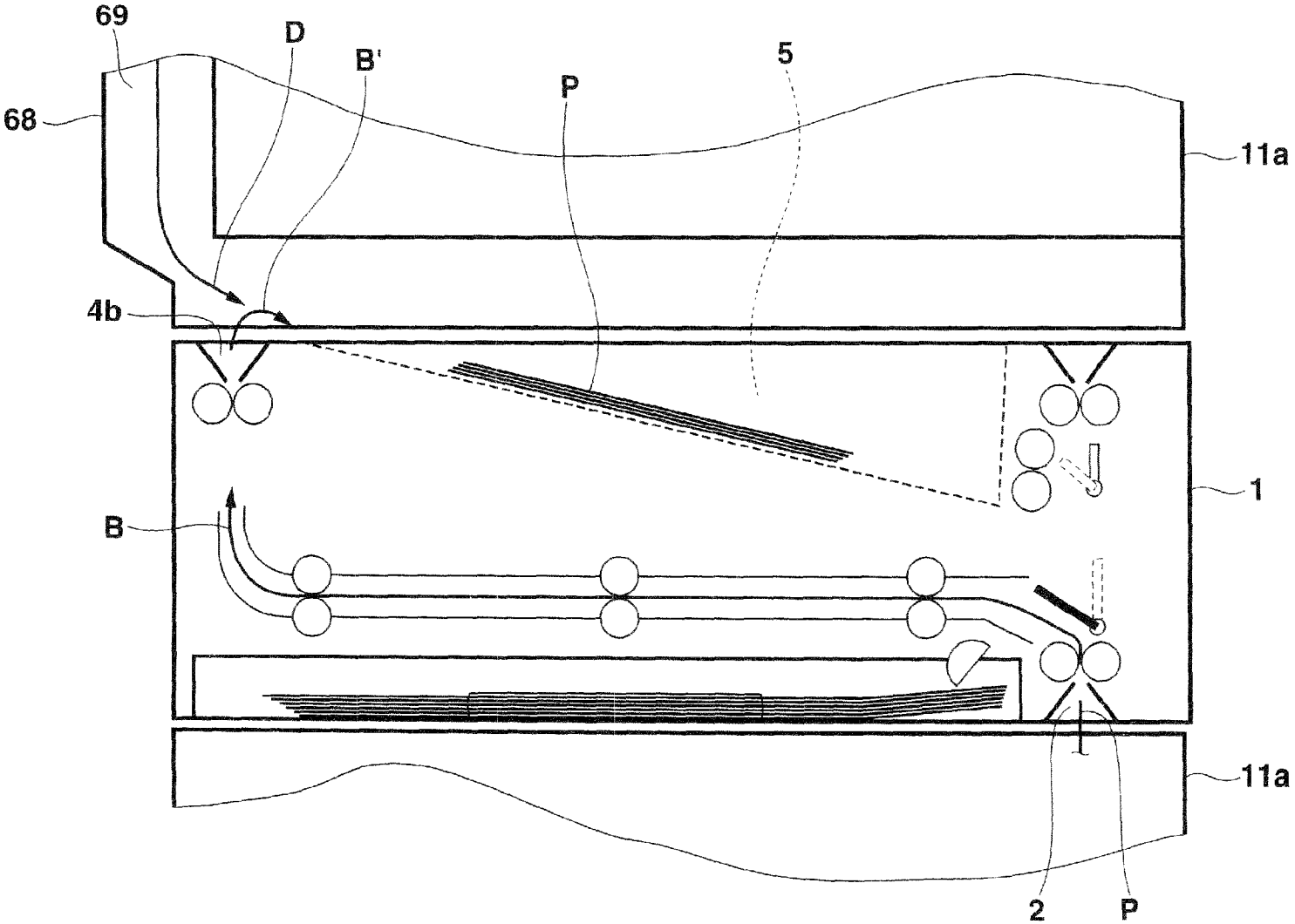
FIG. 7 is a diagram showing a manner to stack printed recording media, which are printed on a shared basis, collectively on a paper discharge tray of the intermediate coupling unit, according to the Example 3 of the Embodiment 3.

FIG. 7 is a diagram showing a manner to stack printed recording media printed OD a shared basis collectively on a paper discharge tray, according to the Example 3 of the Embodiment 3. FIG. 7 shows the travel of a printed recording medium through a conveying path, with the other components simplified.

As shown in FIG. 7, in the present example, a second intermediate coupling unit 68 is placed above the intermediate coupling unit 1 (hereinafter, the previously explained intermediate coupling unit 1 will be referred to as first intermediate coupling unit 1).

The second intermediate coupling unit 68 includes a guide path 69 that takes over a recording medium discharged onto the paper discharge tray 39 not shown in FIG. 7 of the overlying printer 11*a* to convey the recording medium downward along a fourth conveying path D shown on the left hand side of FIG. 7.

Hence, a down-facing image-transferred surface of a recording medium P, which is discharged with the image-transferred surface facing downward onto the paper discharge tray 39 of the overlying printer 11*a*, faces the rightward direction of the drawing when passing through the guide path 69. Then, when the recording medium P is stacked on the paper discharge tray 5 of the first intermediate coupling unit 1, the image-transferred surface faces upward.

On the other hands a left-facing image-transferred surface of a recording medium P, which is discharged with the image-transferred surface facing leftward from the external paper discharge path 52 of the underlying printer 11*a* and carried into the interior of the first intermediate coupling unit from the carry-in port 2 of the first intermediate coupling unit 1, faces downward when passing through the second conveying path B. Then, when the recording medium P exits the discharge port 4*b* and is oriented to change to a direction B' by an unillustrated guide member provided to the second intermediate coupling unit 68 so as to be stacked on the paper discharge tray 5, the image-transferred surface faces upward.

Hence, not only in the case of one-side printing but also in the case of double-side printing, it is possible to have the document sheets that are printed by the upper and lower two printers 11*a* on a shared basis collectively stacked on the paper discharge tray 5 with their image-transferred front or back surface facing the same upward or downward direction.

Further, to arrange in order of page number, in the case of one-side printing, the upper and lower printers 11*a* take on odd number pages and even number pages respectively on a shared basis and take turns to stack the sheets on the paper discharge tray 5. In the case of double-side printing, the printers 11*a* take on printing every other two pages on a shared basis, and take turns stacking the printed sheets on the paper discharge tray 5.

Accordingly, it is possible to have the document sheets that are printed by the upper and lower two printers 11*a* on a shared basis collectively stacked on the paper discharge tray 5 with the page numbers arranged in order.

Embodiment 3-4

It has already been mentioned that the printers 11 (11*a*, 11*b*) described above can singly perform printing (monochrome, full-color, one-side, double-side) normally. However, some manner to assemble the printers onto the first intermediate coupling unit 1 (hereinafter recovered to the simple reference of intermediate coupling unit 1) from above and below may enable double-side printing to be performed fast, i.e. without a kickback behavior of a paper overturning mechanism.

Figure 8:
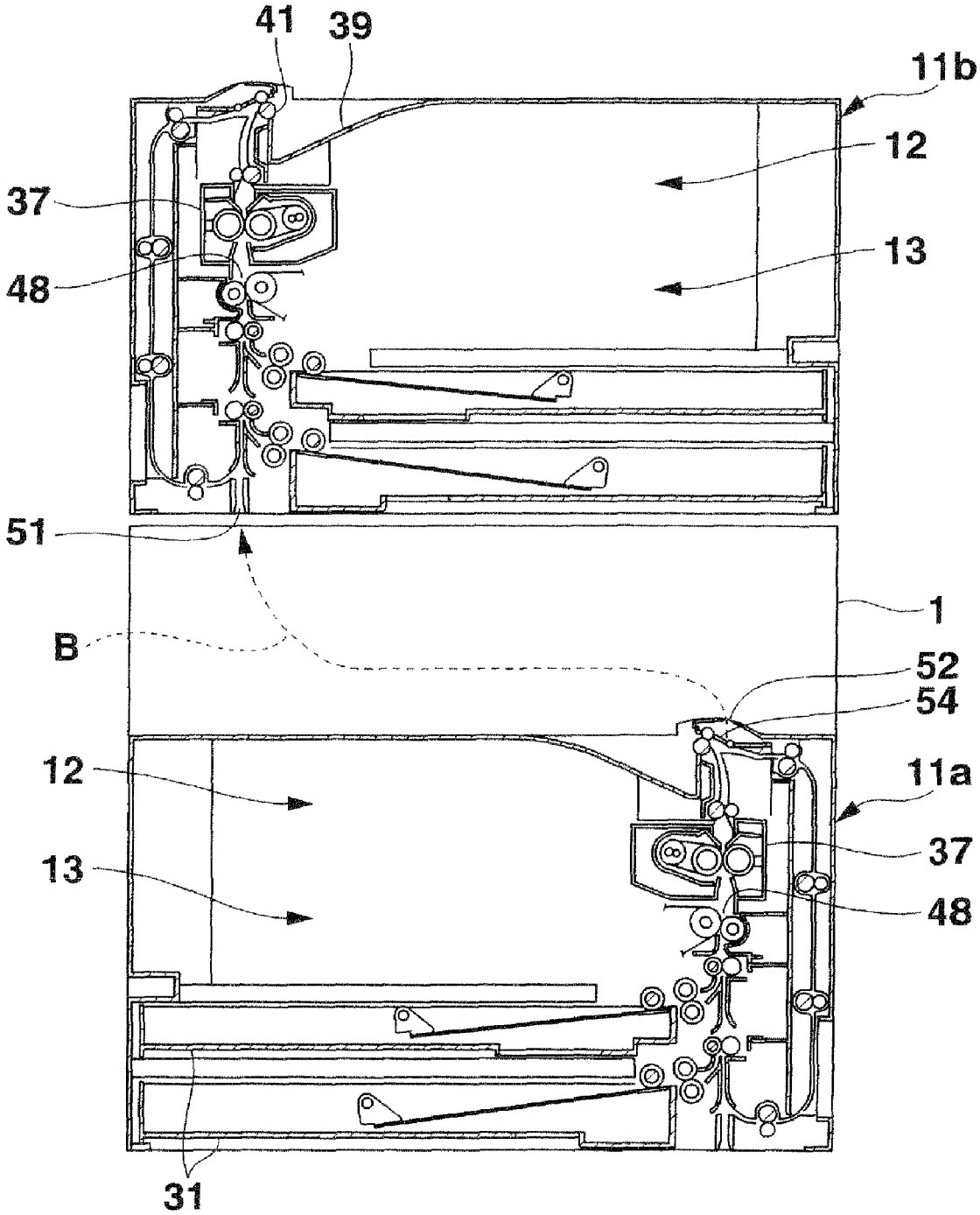
FIG. 8 is a diagram showing a form of combination of the intermediate coupling unit and two printers for performing fast double-side printing, according to the Example 4 of the Embodiment 3.

FIG. 8 is a diagram showing a manner to combine the intermediate coupling unit 1 and the printers 11 (11*a*, 11*b*) for fast double-side printing, according to the Example 4 of the Embodiment 3. Likewise, to avoid making the drawing complicated to see. FIG. 8 omits the image forming section 12 and the intermediate transfer belt unit 13 from the printers 11 (11*a*, 11*b*) and omits all the internal components from the intermediate coupling unit 1.

FIG. 8 assigns the same reference numerals as in FIG. 1, FIG. 2, and FIG. 3 to those of the same components as in FIG. 1, FIG. 2, and FIG. 3 that are indispensable for explanation.

In the present example, two printers, which face different directions with each other, are coupled to the top and bottom of the intermediate coupling unit 1. That is, as shown in FIG. 8, the printer 11*a* in the perspective of FIG. 2 is coupled to the bottom of the intermediate coupling unit 1 and the printer 11*b* in the perspective of FIG. 3 is coupled to the top of the intermediate coupling unit 1.

In the present example, the lower printer 11*a* is set to turn the flap 54 (see FIG. 2) to the broken line position 54' to guide a recording medium P discharged from the belt type fixing unit 37 through the pair of carry-out rollers 38 to the external paper discharge path 52.

After this, the lower printer 11*a* primarily transfers a toner image formed by the image forming section 12 onto the intermediate transfer belt unit 13, and at the secondary transfer unit 48, secondarily transfers the primarily transferred toner image onto a recording medium P picked up from the paper feed cassette 31.

The recording medium P onto which the toner image is secondarily transferred is conveyed to the belt type fixing unit 37. After the belt type fixing unit 37 fixes the toner image onto the sheet surface, the recording medium P is discharged from the external paper discharge path 52 to the external paper feed path 51 of the printer 11*b*.

The recording medium P discharged into the intermediate coupling unit 1 is conveyed through the second conveying path B (see FIG. 1) in the intermediate coupling unit 1 to be carried into the printer 11*b* coupled to the top of the intermediate coupling unit 1 from the external paper feed path 51 of the printer 11*b*.

In this case, the image-transferred surface of the recording medium P faces leftward when the recording medium P is discharged from the lower printer 11*a*. While the recording medium P is passing through the second conveying path B in the intermediate coupling unit 1, the image-transferred surface faces downward. When the recording medium P is carried into the upper printer 11*b* from the external paper feed path 51, the image-transferred surface again faces leftward.

That is, the image-formed surface of the recording medium P carried into the upper printer 11*b* faces leftward in FIG. 8. Accordingly, the right side of the recording medium P is a surface on which no image has been formed yet. The upper printer 11*b* to which the recording medium P has just been carried in has an opposite arrangement of the secondary transfer unit 48 to that in the lower printer 11*a*.

With this arrangement, a toner image is secondarily transferred by the secondary transfer unit 48 of the printer 11*b* onto the rightward-facing surface of the recording medium P carried into the upper printer 11*b* on which surface no image has yet been formed, and the toner image is fixed onto that sheet surface by the belt type fixing unit 37. Then, the recording medium P is discharged onto the paper discharge tray 39 by the pair of paper discharge rollers 41.

As can be known, according to the present example, only taking the second conveying path B in the intermediate coupling unit 1 enables double-side printing with no kickback behavior of a paper overturning mechanism.

The time that elapses for the first sheet that is printed to pass through the second conveying path B adds to the time taken for printing, but the following sheets are printed continuously. Hence, the time taken for the following sheets to pass through the second conveying path B does not affect the time that has elapsed for printing, and double-side printed recording media P are continuously discharged onto the paper discharge tray 39 of the upper printer 11*b* at the same process speed as the normal one-side printing.

Embodiment 3-5

Figure 9:
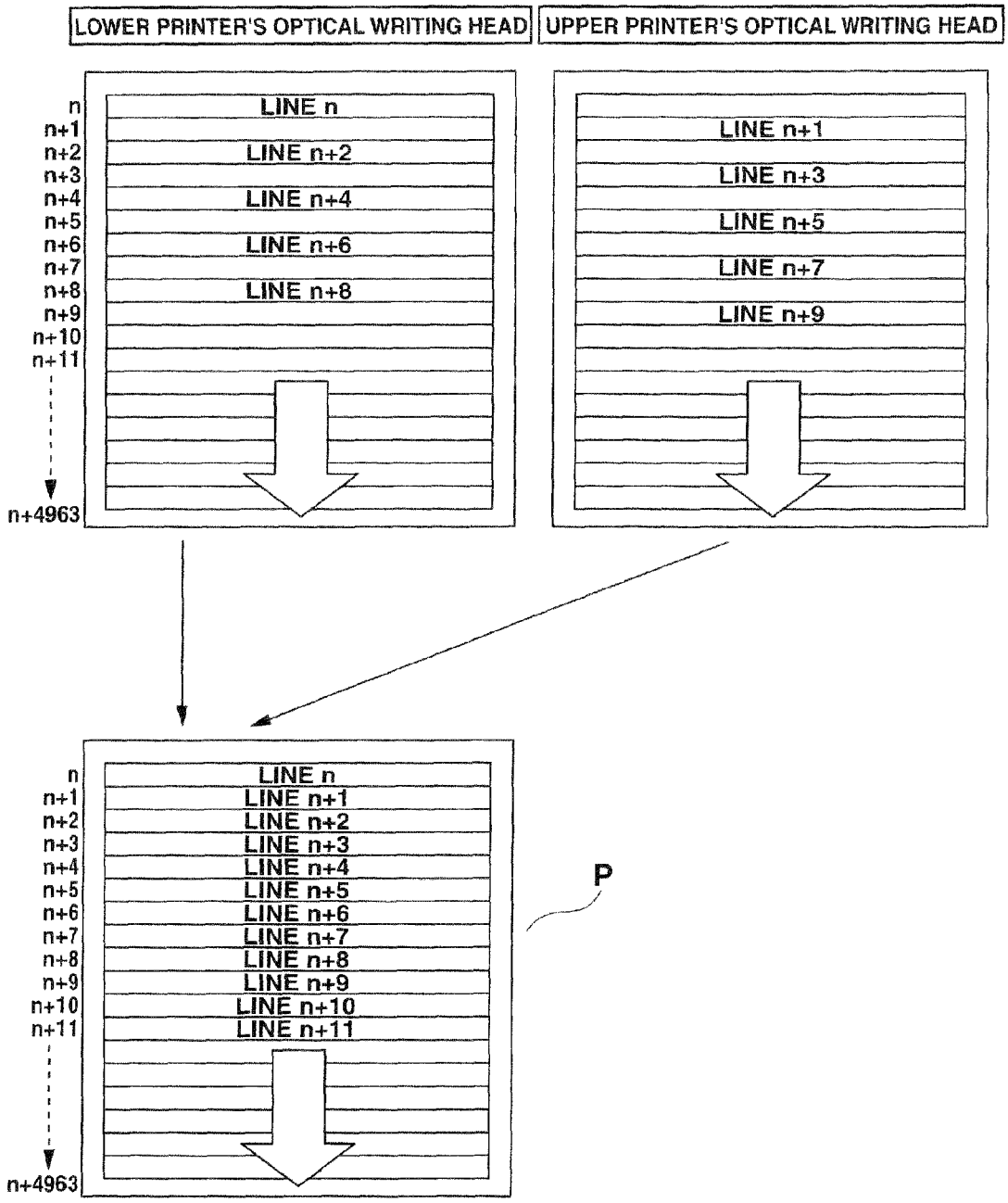
FIG. 9 is a diagram explaining a special printing manner realized by a combination of the intermediate coupling unit and two printers, according to the Example 5 of the Embodiment 3.

FIG. 9 is a diagram explaining a special printing manner realized by a combination of the intermediate coupling unit and two printers, according to the Example 5 of the Embodiment 3. The manner to combine the intermediate coupling unit 1 and two printers 11*a* according to the present example is the same as shown in FIG. 5.

Generally, the optical writing head 21 of the printer 11 (see FIG. 2 or FIG. 3 hereinafter) includes multiple LED elements that are arranged in one line on a substrate. The multiple LED elements are arranged on the substrate in chip units. Hence, the chips might have unevenness in the arrangement.

Further, the LED elements have unevenness in the amount of light to emit due to the characteristic of each element. Hence, due to the unevenness in the characteristic, the optical writing head 21 having the above configuration might possibly produce a writing unevenness that may appear as a streak running in the vertical scanning direction.

Further, the photoconductive drums 17 used in the respective image forming units 16 also have uneven characteristics, which produce unevenness in the sensitivity of the photoconductive drums 17 in getting charged.

Furthermore, the developing rollers 23, to which a developing bias is applied, also have slightly different characteristics. Hence, in the printer 11 of the present example, the image forming units 16 might produce unevenness that has a shape of a vertical or horizontal stripe.

Hence, according to the present example, an unillustrated host apparatus such as a personal computer, which is connected by an unillustrated harness to the intermediate coupling unit 1 and two printers 11*a* to control the system, splits video data color by color into two to generate video data for sub-lines "1/2" and "2/2", for a dot pattern to be developed in the frame memory 66 of the I/F controller 61 of the two printers 11*a*.

FIG. 9 is a diagram showing a state of image data being printed on a recording medium P through the above process. According to the above process, the optical writing heads 21 of the lower printer 11*a* print an n-th line, an (n+2)-th line, an (n+4)-th line, . . . on the recording medium P color by color, as shown in the upper left corner of FIG. 9.

Then, likewise color by color, the optical writing heads 21 of the upper printer 11*a* print an (n+1)-th line, an (n+3)-th line, an (n+5)-th line, . . . as shown in the upper right corner of FIG. 9. By this process, the recording medium P has got the printing shown in the lower left corer of FIG. 9.

This process can offset unevenness, if any, in the amount of light emitted by the LED elements that constitute the optical writing head 21 of each color, and enable printing with an improved print quality.

Embodiment 4

Figure 10:
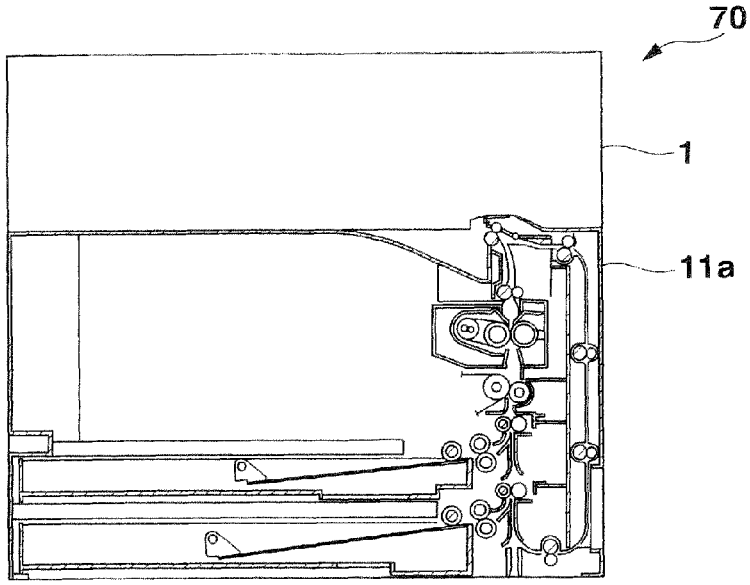
FIG. 10 is a diagram showing an example printer provided with an intermediate coupling unit function for coupling another printer, according to the Embodiment 4.

FIG. 10 is a diagram showing an example printer that is pre-packaged with an intermediate coupling unit function for coupling another printer, according to the Embodiment 4. As shown in FIG. 10, the printer 70 according to the present example takes a form of the above-described printer 11*a*, which is pre-integrated with the intermediate coupling unit 1 for coupling the printer 11*a* or the printer 11*b*.

If the printer 11*a* is pre-provided with an intermediate coupling mechanism like the printer 70 of the present example, when a printer system as described in the Embodiments 1 to 3 becomes necessary, it is possible to realize a vertically-two-stage tandem printer system as shown in FIG. 6 or FIG. 8 only by adding another one printer 11 (11*a*, 11*b*).

The present example shows a case of the intermediate coupling unit 1 being integrally formed on the top of the printer 11*a*. However, the same effect can be obtained from a configuration of the intermediate coupling unit 1 being integrally formed on the bottom of the printer 11*a*.

Embodiment 5

Figure 11:
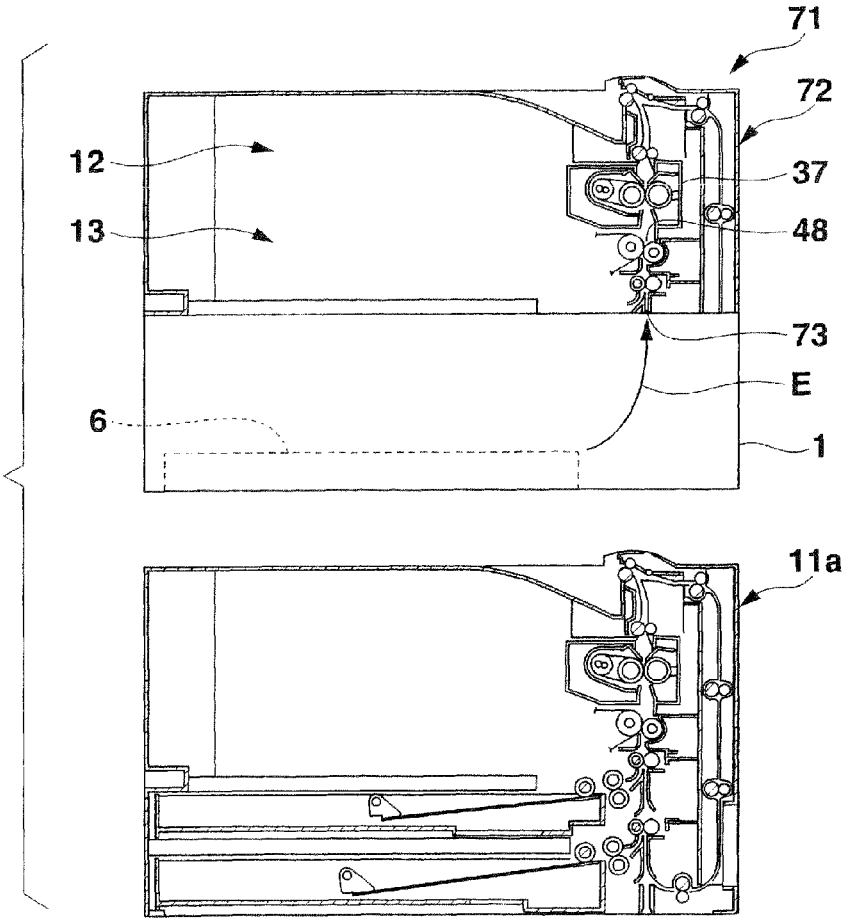
FIG. 11 is a diagram showing the configuration of a printer, from which a paper feed mechanism indispensable as a printer function is eliminated as substituted for by a paper feed mechanism of the intermediate coupling unit, according to the Embodiment 5.

FIG. 11 is a diagram showing a configuration of a printer, from which a paper feed mechanism indispensable as a printer function is eliminated as substituted for by a paper feed mechanism of the intermediate coupling unit, according to the Embodiment 5.

As shown in the upper section of FIG. 11, the printer 71 according to the present example includes an upper apparatus 72 that likewise includes the image forming section 12, the intermediate transfer belt unit 13, the secondary transfer unit 48, and the belt type fixing unit 37 of the printer 11 shown in FIG. 2 or FIG. 3 but eliminates the paper feed unit 14, below which apparatus the intermediate coupling unit 1 is integrally formed.

When the printer 71 singly performs printing, a recording medium is fed from the paper feed cassette 6 of the intermediate coupling unit 1 instead of the nonexistent paper feed unit 14 to a recording medium carry-in port 73 of the upper apparatus 72 as indicated by a conveying path E.

Functionally, the printer 71 is nearly alike to the Embodiment 4, in a respect that the printer 71 has the intermediate coupling unit 1 arranged below the upper apparatus 72 that performs printing. However, the printer 71 is less expensive than the Embodiment 4 by an amount equivalent to the paper feed unit 14 that is eliminated.

When a printer system as described in the Embodiments 1 to 3 becomes necessary, the printer 71 according to the present example can also realize a vertically-two-stage tandem printer system as shown in FIG. 6 (likewise as shown in FIG. 8, if the printer 11*a* is turned), with another printer 11*a* added and coupled to the bottom of the intermediate coupling unit 1, as shown in the lower section of FIG. 11.

The intermediate coupling unit 1 may include in addition to the first, second, and third conveying paths A, B, and C, the paper discharge tray 5, and the paper feed cassette 6 described above, a finisher function that punches a hole in a recording medium P stacked on the paper discharge tray 5 or binds each predetermined number of sheets together with binding hardware, though not shown in particular.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of cm equivalent of the claims of the invention and within the claims are to be regarded to be in the scope of the present invention.

This application is based on Japanese Patent Application No. 2008-167741 filed on Jun. 26, 2008 and including specification, claims, drawings and summary. The disclosure of the above Japanese Patent Application is incorporated herein by reference in its entirety.

What is claimed is:

1. An intermediate coupling unit that is installed in an attachable and detachable manner between two image forming apparatuses, which are arranged in a vertical direction, comprising:

a first conveying path that conveys a recording medium discharged from a lower one of the image forming apparatuses to an upper one of the image forming apparatuses without changing a direction in which the recording medium is discharged;

a second conveying path that conveys a recording medium discharged from the lower image forming apparatus to the upper image forming apparatus by changing the direction in which the recording medium is discharged; and a third conveying path that leads a recording medium discharged from the lower image forming apparatus to an internal paper discharge tray to be contained therein without conveying the recording medium to the upper image forming apparatus.

2. The intermediate coupling unit according to claim 1, further comprising a paper feed cassette that is attachable to and detachable from a lower portion of a body of the intermediate coupling unit, wherein the first or the second conveying path is adapted to convey a recording medium which is fed from the paper feed cassette to the upper image forming apparatus.

3. The intermediate coupling unit according to claim 1, further comprising a paper feed cassette that is attachable to and detachable from a lower portion of a body of the intermediate coupling unit;

wherein when the paper feed cassette is detached from the body of the intermediate coupling unit, an internal space of the intermediate coupling unit that is formed due to the detachment constitutes a space above a paper discharge tray of the lower image forming apparatus.

4. An image forming apparatus, comprising:

an image recording unit for recording a toner image;

a transfer medium onto which the toner image is primarily transferred by the image recording unit;

a pair of standby conveying rollers that conveys a recording medium, which is fed from a paper feed cassette, correspondingly to a recording timing;

a secondary transfer unit that secondarily transfers the toner image onto the recording medium from the transfer medium onto which the toner image has been primarily transferred;

a recording medium conveying path that is formed by a substantially-vertical sequential bottom-up alignment of a recording medium carry-in port of a fixing unit and a recording medium discharge port of the fixing unit, the fixing unit fixing the toner image on the recording medium onto which the toner image has been secondarily transferred;

an external paper feed path that, in a portion of the recording medium conveying path that is below the pair of standby conveying rollers, joins a paper feed path through which a recording medium is fed from the paper feed cassette, a paper-feeding-side end of the external paper feed path, which is below a region where the joining occurs, opening downward to outside; and an external paper discharge path that branches from a recording medium discharge path leading to a paper discharge tray in a portion of the recording medium conveying path that is above the recording medium discharge port of the fixing unit and that opens upward to outside at a paper-discharging-side end of the external paper discharge path, which is above a region where the branching occurs, wherein the image forming apparatus is capable of singly performing printing on the recording medium, and wherein the image forming apparatus is capable of being coupled to the intermediate coupling unit according to claim 1, 2, or 3 in an attachable and detachable manner at an upper surface or at a lower surface of the image forming apparatus.

5. The intermediate coupling unit according to claim 1, wherein each of the image forming apparatuses is capable of singly forming an image.

* * * * *